US006043660A

United States Patent [19]

Bahr et al.

[11] Patent Number: 6,043,660

[45] **Date of Patent: *Mar. 28, 2000**

[54] CIRCUIT ARRANGEMENT FOR MEASURING AN ION CURRENT IN A COMBUSTION CHAMBER OF AN INTERNAL COMBUSTION ENGINE

[75] Inventors: Ulrich Bahr, Braunschweig; Michael Daetz, Tiddische, both of Germany

[73] Assignees: DaimlerChrysler AG, Stuttgart; Volkswagen AG, Wolfsburg, both of Germany

[ * ] Notice: This patent is subject to a terminal disclaimer.

[21] Appl. No.: 08/802,896

[22] Filed: Feb. 18, 1997

[30] Foreign Application Priority Data

Feb. 16, 1996 [DE] Germany ..... 196 05 803

[51] Int. Cl.[7] ..... F02P 17/00

[52] U.S. Cl. ..... 324/380; 324/399; 324/393; 324/402

[58] Field of Search ..... 324/393, 399, 324/380, 378, 402; 123/406.26, 406.27, 406.37; 73/35.08

[56] References Cited

U.S. PATENT DOCUMENTS

| | | | |
|---|---|---|---|
| 5,293,129 | 3/1994 | Ikeuchi et al. | 324/399 |
| 5,444,375 | 8/1995 | Ohsawa et al. | 324/380 |
| 5,483,818 | 1/1996 | Brandt et al. | 73/35.01 |
| 5,493,227 | 2/1996 | Shimasaki et al. | 324/378 |
| 5,758,629 | 6/1998 | Bahr | 123/644 |

FOREIGN PATENT DOCUMENTS

| | | |
|---|---|---|
| 0260177 | 3/1988 | European Pat. Off. . |
| 3006665 | 9/1981 | Germany . |
| 4116272 | 11/1991 | Germany . |
| 4233224 | 4/1993 | Germany . |
| 4239803 | 5/1993 | Germany . |
| 4303267 | 8/1993 | Germany . |
| 195 02 402 | 8/1995 | Germany . |
| 6-299941 | 10/1994 | Japan . |

*Primary Examiner*—Josie Ballato
*Assistant Examiner*—Russell M. Kobert
*Attorney, Agent, or Firm*—W. F. Fasse; W. G. Fasse

[57] ABSTRACT

A circuit arrangement measures an ion current generated in the combustion chamber of an internal combustion engine during an iron current flow phase following an ignition phase. A voltage drop across a feedback resistor ($R_1$) connected in parallel to an inverting amplifier is measured since the voltage drop is proportional to the ion current resistance. The amplifier is connected with its inverting input to a low voltage end of a secondary winding of an ignition transformer or coil. The high voltage end of the secondary winding is connected through a spark gap of a spark plug to ground, whereby the spark plug functions as an ion current sensor during the ion current flow phase. Negative voltage peaks flowing during an ignition phase and the ignition current flowing during the ignition phase are diverted through respective first and second circuit branches. The first branch has a first semiconductor diode ($D_1$) grounding the low voltage end of the secondary winding for discharging the negative high voltage peaks while blocking the ignition current. The other diverting branch has a second semiconductor ($D_2$) connected in parallel to the inverting amplifier.

14 Claims, 2 Drawing Sheets

CIRCUIT ARRANGEMENT FOR MEASURING AN ION CURRENT IN A COMBUSTION CHAMBER OF AN INTERNAL COMBUSTION ENGINE

CROSS-REFERENCE TO RELATED APPLICATIONS

The present application is related to, commonly assigned applications U.S. Ser. No. 08/802,898, which issued as U.S. Pat. No. 5,914,604 on Jun. 22, 1999; and U.S. Ser. No. 08/892,889, which issued as U.S. Pat. No. 5,758,629 on Jun. 2, 1998.

INCORPORATION BY REFERENCE

The disclosure of German parent case No. 196 05 803.1, filed on Feb. 16, 1996 is hereby incorporated by reference into the present disclosure.

FIELD OF THE INVENTION

The invention relates to a circuit arrangement for measuring an ion current occurring in a combustion chamber of an internal combustion engine after the flow of an ignition current, when an ignition spark has been extinguished, and prior to the next sparking or ignition phase.

BACKGROUND INFORMATION

U.S. Pat. No. 5,483,818 discloses an ion measuring circuit of the type described above. The known circuit comprises an inverting amplifier wired as a differential amplifier, the inverting input of which is connected through a resistor to the low voltage potential side of the secondary winding of an ignition coil also referred to as an ignition transformer having a primary winding and a secondary winding. The differential amplifier has a further non-inverting input connected to a biasing voltage of about 40 V. The inverting amplification characteristic of the differential amplifier is achieved by connecting a feedback resistor in parallel between the output of the amplifier and the inverting input thereof. The output of the differential amplifier is simultaneously connected to a signal evaluating threshold circuit. Furthermore, the low potential end of the secondary winding is connected through two series connected Zener diodes to ground potential. The connecting point between the two serially connected Zener diodes is connected to a further inverting amplifier which controls this connecting point in such a way that during an ion current measuring operation any leakage currents are avoided in order to produce accurate ion current representing signals which are not falsified by any leakage currents. The second inverting amplifier is wired or constructed in the same way as the inverting amplifier directly connected to the low voltage end of the secondary winding. In other words, the output of the second amplifier is also connected through a resistor to the inverting input of the second amplifier. The non-inverting input of the second amplifier is connected to the same biasing voltage of about 40 V as the first amplifier.

The circuit arrangement of the above mentioned U.S. Patent is not cost efficient since it requires two inverting differential amplifiers for avoiding ion current measurement errors that may otherwise be caused by the leakage currents of the two Zener diodes. Thus, there is room for improvement.

OBJECTS OF THE INVENTION

In view of the above it is the aim of the invention to achieve the following objects singly or in combination:

- to improve an ion current measuring circuit arrangement of the type described above in such a way that at least the same or a better ion current measuring accuracy is achieved with fewer circuit components and to avoid the disadvantages of the prior art;
- to avoid the use of Zener diodes at critical circuit points where leakage currents must be prevented by using semiconductor diodes which do not have high leakage currents at these critical circuit points;
- to substantially reduce the measuring voltage to a value well below the 40 V of the prior art;
- to use the present circuit arrangement both for measuring the ion current between ignition or sparking phases and for measuring the ignition current during ignition or sparking phases, whereby the latter can be used to control follow-up ignition signals while the former can be used to control the initial ignition time of an ignition cycle to reduce or avoid engine knocking and/or to detect ignition failures and/or to detect the position of the cam shaft relative to the crankshaft;
- to measure the ignition current and/or the ion current for a plurality of spark plugs connected in parallel to each other by a single circuit arrangement provided in common for all spark plugs; and
- to improve the decay characteristics after each ignition spark in such an ignition circuit system for facilitating the ion current measurement between ignition phases.

SUMMARY OF THE INVENTION

An ignition circuit of the type described above is improved according to the invention by a diverting or shunting circuit having two branches connected to a circuit point (S) to which the low voltage end or all low voltage ends of the secondary windings of the ignition transformers are connected in common. The ignition current flows during the sparking or ignition phase of one or more spark plugs, while the ion current is caused to flow between ignition phases. The first diverting circuit branch comprises a semiconductor diode ($D_1$) connecting said circuit point (S) to ground for dissipating any negative voltage peaks that may occur at the moment when sparking begins. The second diverting circuit branch comprises a second semiconductor diode ($D_2$) connected in parallel to the output of an inverting amplifier and to the inverting input of the inverting amplifier for diverting the ignition current during ignition phases. The most important advantage of such a diverting circuit having two branches according to the invention is seen in that normal or regular semiconductor diodes can be used rather than Zener diodes having high leakage currents thereby avoiding the high leakage current problem present in the above mentioned conventional circuit. By using regular semiconductor diodes, the present circuit arrangement becomes substantially simpler.

Another advantage of the circuit arrangement according to the invention is seen in that it permits substantially reducing the value of the measuring voltage compared to the prior art calling for a measuring voltage of 40 V, whereas according to the invention the measuring voltage may be within the range of 5 to 30 V, preferably 20 V.

According to an advantageous further embodiment of the invention the second diverting branch comprises an ignition current measuring resistor ($R_2$) connected in series with the second semiconductor diode ($D_2$). The voltage drop across this ignition current measuring resistor during the sparking or ignition phase of the respective spark plug is proportional to the size of the ignition current and the resulting signal can be further processed for controlling the follow-up ignition sequence within an ignition cycle started by a timing circuit.

In a preferred embodiment the second branch of the diverting circuit is connected through a controllable semiconductor switch to ground potential. The controllable semiconductor switch is preferably a transistor the control electrode of which is connected to the output of the inverting amplifier. Such a controllable semiconductor switch has the advantage that it permits increasing the current loadability of the inverting amplifier which is preferably a differential amplifier and which is thus not overloaded. In such an embodiment one input of the differential amplifier is preferably connected to the low potential end of the secondary winding of the ignition transformer while the other input of the differential amplifier is connected to a reference voltage the value of which corresponds to a measuring or testing voltage for causing an ion current flow between ignition phases. The ion current flow caused for testing passes through an ion current measuring resistor ($R_1$) connected in parallel to the differential amplifier. More specifically, one end of the ion current measuring resistor (R) is connected to the output of the amplifier while the other end of the resistor ($R_1$) is connected to the first mentioned input of the amplifier that is connected to the common point (S) to which one or all low voltage ends of the secondary windings are connected. Thus, the ion current is easily measured with simple circuit components since the voltage drop across the ion current measuring resistor is proportional to the ion current and the respective voltage drop can be further processed for evaluation to provide a control signal, for example for the above mentioned control of the initial timing impulse for the starting of an ignition cycle to thereby reduce engine knocking or to determine an ignition failure or to ascertain the cam shaft position relative to the crankshaft position.

The above mentioned reference voltage supplied to the other input of the differential amplifier is provided by a constant voltage source.

In connection with a multi-cylinder internal combustion engine it is possible to connect the secondary windings and thus the spark plugs which function as ion current probes or sensors in parallel to each other, thereby providing the advantage that the same diverting circuit branches can be used for all spark plugs. However, where for highly accurate measurements it is desirable to measure each ignition path and thus each spark plug separately with regard to the ion current flow, each spark plug ignition circuit may be provided with a circuit arrangement according to the invention to thereby measure each spark plug independently of any other spark plug. In such a circuit arrangement the output signals would be time multi-plexed for evaluation.

According to an especially preferred embodiment of the invention each secondary winding of the ignition system for a multi-cylinder engine is connected through a respective parallel circuit to the above mentioned common circuit point (S). Each parallel circuit comprises a dissipation resistance ($R_3$) connected in parallel to at least one Zener diode. Such a circuit controls the decay characteristic of the respective ignition circuit after each termination of the ignition spark so that energy that may remain after the spark termination in the ignition coil or in any secondary capacities is rapidly dissipated without any substantial time delay so that the respective ion current measurement can be performed forthwith between two ignition phases. In order to provide a symmetric decay control two Zener diodes are preferably connected in anti-serial fashion with each other and in parallel to the dissipation resistor ($R_3$). Such a circuit shortens the decay period and additionally makes the decay characteristic symmetric.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
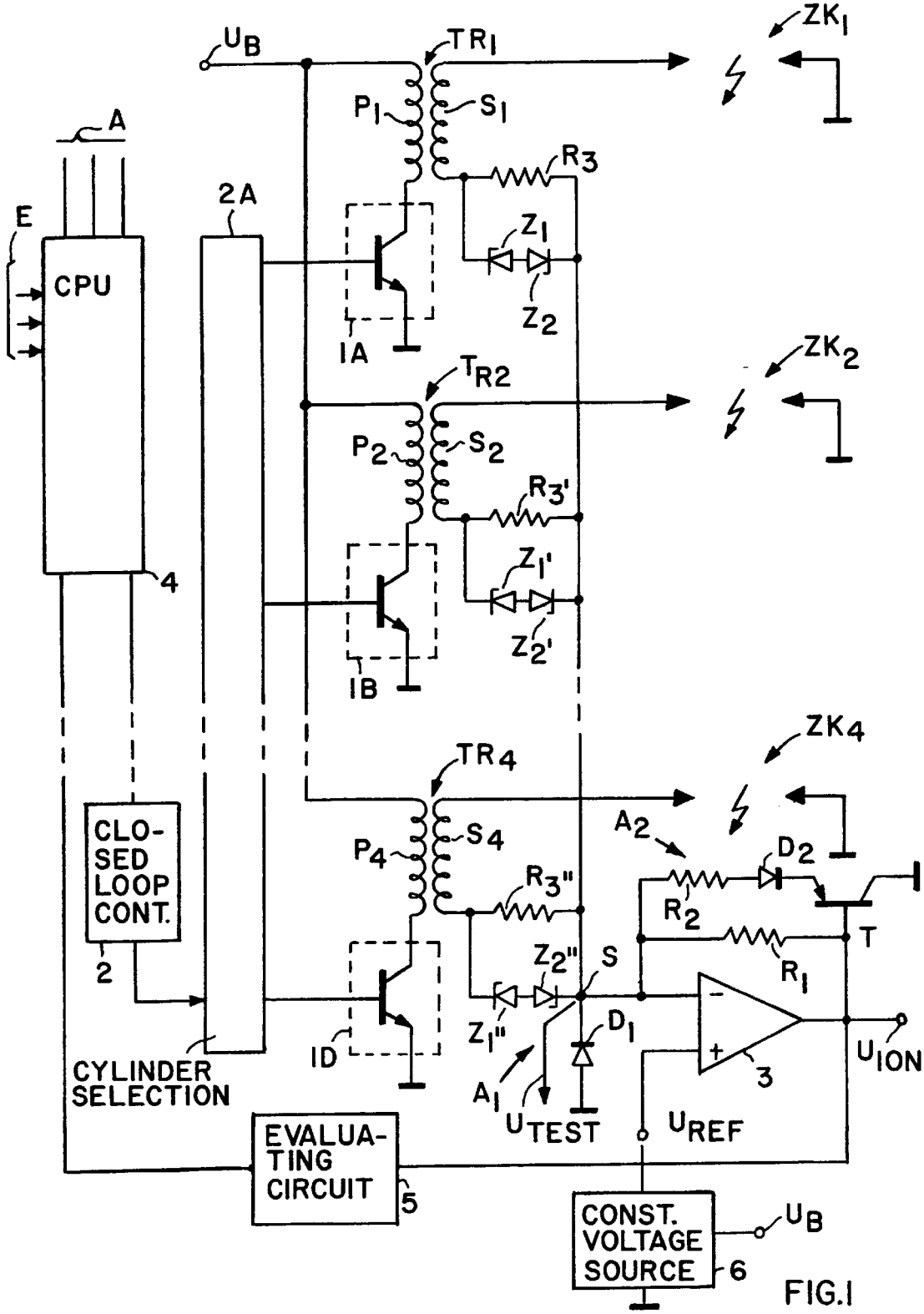
FIG. 1 is an ignition circuit diagram of a circuit arrangement according to the invention for a four cylinder engine.

FIG. 1 shows a transistor ignition circuit for a four cylinder internal combustion engine. Each cylinder has its own spark plug $Zk_1 \ldots Zk_4$. Further, each cylinder has its own ignition coil or transformer $Tr_1 \ldots Tr_4$. Each ignition transformer has a primary winding $P_1 \ldots P_4$ and a secondary winding $S_1 \ldots S_4$. The spark plugs $Zk_1 \ldots Zk_4$ are connected between the high voltage end of the respective secondary winding $S_1 \ldots S_4$ and ground. One end of the primary windings is connected to a common supply battery $U_B$. The other end of the primary windings is connected to a respective power amplifier or switch 1A, 1B, 1C, and 1D. These power switches are transistor amplifiers connected with their control electrodes to a timing circuit 2A which in turn is connected to a closed loop control circuit 2 having an input connected to a central processing unit 4. The battery $U_B$ provides a voltage for example of 12 V. The timing circuit 2A selects the cylinder ignition sequence which in turn is controlled through the closed loop control circuit 2 by the central processing unit 4.

The central processing unit 4 functions as an engine management circuit which receives at its inputs E various engine parameters such as a load parameter, an r.p.m. value, and temperature values and the like. The central processing unit 4 has outputs A which control respective sensors for the just mentioned parameters.

As mentioned, the high voltage end of each secondary winding $S_1 \ldots S_4$ is connected to the respective spark plug $Zk_1 \ldots Zk_4$ while the low potential ends of the secondary windings are connected through a dissipation resistor $R_3$ to a common circuit point S.

The common circuit point S is connected to the inverting input (−) of an inverting amplifier 3 that is wired as a differential amplifier which also has a non-inverting input (+) connected to a constant reference voltage Uref within the range of 5 to 30 V, preferably 20 V. The constant reference voltage is provided by a constant voltage source 6. This reference voltage is supplied by a feedback resistor $R_1$ to the common circuit point S and thus to the secondary windings $S_1$, $S_2$ wherein the reference voltage functions as a measuring or testing voltage $U_{test}$ for the ignition spark plugs $Zk_1 \ldots Zk_4$ functioning, between sparking times or ignition phases, as sensors or probes for measuring an ion current caused to flow by the application of the testing voltage $U_{test}$. The ion current is measured as a voltage drop across the feedback resistor $R_1$. This voltage drop is proportional to the ion current. Thus, the resistor $R_1$ performs two functions, first it is a feedback circuit during ignition phases and second, it is an ion current measuring resistor during an ion current flow phase between ignition phases.

According to the invention the circuit arrangement just described comprises a diverting circuit with a first branch $A_1$ and a second branch $A_2$. The first branch $A_1$ comprises a first semiconductor diode $D_1$ connected with its anode to ground potential and with its cathode to the common circuit point S for dissipating at the instant of high voltage sparking any negative voltage peaks that may occur at this time. The second diverting circuit branch $A_2$ for shunting the ignition current flowing during the sparking times of any one of the spark plugs $Zk_1 \ldots Zk_4$, comprises a second semiconductor diode $D_2$ connected in parallel to the inverting input and the output of the differential amplifier 3. Preferably, the second diverting circuit branch $A_2$ comprises a second resistor $R_2$ connected in series with the second semiconductor diode $D_2$. This series circuit is further connected in series with the emitter collector circuit of an pnp-transistor T functioning as a controllable switch, whereby the ignition current measuring resistor $R_2$ is connected with one end to the common circuit point S while the collector electrode of the transistor T is connected to ground potential in the embodiment of FIG. 1. The base electrode of the transistor T is connected with the output of the differential amplifier 3 for controlling the transistor switch T for increasing the current loadability of the differential amplifier 3 or rather to prevent its overloading.

The ignition current flowing during sparking of any one of the spark plugs is diverted through the second branch $A_2$ which can be wired even without the transistor T. However, using the transistor T as a switch is preferred, since it increases, as mentioned, the current loadability of the differential amplifier 3. If no transistor T is used in the second branch $A_2$, the cathode of the semiconductor diode $D_2$ is directly connected to the output of the differential amplifier 3, whereby the second branch $A_2$ of the diverting circuit is connected in parallel to the feedback and ion current measuring resistor $R_1$.

The operation of the present circuit arrangement will now be described with reference to FIG. 1. The generation of an ignition impulse through the closed loop control circuit 2 and 2A energizes the respective power amplifier 1A to 1D and thus provides an ignition voltage to the respective spark plugs $Zk_1 \ldots Zk_4$. The resulting ignition spark is sustained for a certain sparking duration or phase during which an ignition current flows through the respective spark plug. This ignition current flows on the one hand through the low impedance diverting circuit branch $A_2$ and on the other hand through the differential amplifier 3. The division of the ignition current depends on the adjustment of the working point of the transistor T, the collector of which is connected to ground potential in FIG. 1. This working point of the transistor T is determined by the output signal $U_{ion}$ of the differential amplifier 3 which controls the transistor T. This output signal or voltage $U_{ion}$ controls in closed loop fashion through the feedback resistor $R_1$ the reference potential at the inverting input (−) of the differential amplifier 3. This reference potential or voltage represents the measuring voltage $U_{test}$ for the next ion current measurement. The use of the transistor T avoids an overloading of the differential amplifier 3 by the ignition current, as mentioned above.

During a sparking duration when a spark is sustained between the sparking electrodes of the respective spark plug, the output signal $U_{ion}$ of the differential amplifier 3 is proportional to the size of the ignition current flowing through the ignition current measuring resistor $R_2$. Thus, during these sparking times this output voltage of the amplifier 3 is considered as a measured signal of the ignition current $I_{sec}$ and this signal is evaluated through the evaluating circuit 5 and then supplied through the output of the circuit 5 to the central processing unit 4. The central processing unit provides, after processing, a control signal to the closed loop control 2 for the charging of the primary windings $P_1 \ldots P_4$ and also for controlling in closed loop fashion the duration of the time during which a spark is sustained in any particular cylinder of the internal combustion engine. The value of the ignition current measuring resistor $R_2$ is so selected that the voltage drop $U_{R2}$ across this resistor $R_2$ corresponds to $U_{R2}=R_2 \times I_{ign}$ and is within the range of a few volts. Such a resistor is, for example, 15 Ω. At the output of the differential amplifier 3 the voltage $U_{ion}$ during the times when the ignition is being measured, corresponds actually to the following equation:

$$U_{ion}=U_{ref}-(I_{ign} \times R_2)-U_{D2}-U_{BE}$$

wherein $U_{ref}$ is the reference voltage from the constant voltage source 6, $I_{ign}$ is the ignition current, $U_{D2}$ is the voltage across the diode $D_2$ when current is flowing, and $U_{BE}$ is the base emitter voltage of the transistor T.

The measured voltage that is proportional to the size of the ignition current could also be picked up at the emitter of the transistor T or as a high impedance pick up at the anode of the diode $D_2$. The tolerances of the base emitter voltage of the transistor T and the voltage drop across the diode $D_2$ during ignition when a spark is sustained would then not enter into the measurement. A further possibility of producing a measured voltage proportional to the ignition current has been achieved with the modified circuit of FIG. 2 to be described below.

When the arc is extinguished at the end of a sparking duration, it is necessary to quickly dissipate any remaining energy in the secondary windings $S_1 \ldots S_4$ or in any secondary capacities. For this purpose, the above mentioned dissipation resistor $R_3$ is connected between the low voltage end of each secondary winding and the common circuit point S. At least one, preferably two, Zener diodes $Z_1$ and $Z_2$ are connected in parallel to the dissipation resistor $R_3$, whereby the two Zener diodes are connected in anti-serial fashion with each other. Such a parallel circuit as described substantially reduces the decaying time following the extinguishing of the ignition spark so that directly thereafter the measurement of the ion current can take place without interference by any prolonged dissipation characteristic.

The just described accelerated energy dissipation following a spark termination is especially important for engines operating at a high r.p.m. The value of the dissipation resistance $R_3$ is preferably so selected that it corresponds to a value $(L_{sec}/C_{sec})^{1/2}$, whereby $L_{sec}$ corresponds to the inductivity of the secondary windings $S_1 \ldots S_4$ while $C_{sec}$ corresponds to the winding and stray capacities of the ignition circuit. The value of the dissipation resistor 3 will normally be selected within the range between 10 kΩ and 100 kΩ and thus will assure a rapid dissipation of any remainder energy.

One Zener diode, or preferably two Zener diodes $Z_1$ and $Z_2$ are used for limiting the voltage drop across the dissipation resistor $R_3$ in order to avoid a substantial reduction of the ignition energy. For example, an ignition current of 100 mA through a resistor of 50 kΩ would cause a voltage drop of 5000 V. The Zener voltages of the Zener diodes $Z_1$ and $Z_2$ are thus selected so that only a small reduction of the ignition energy or, more specifically a small voltage drop is involved, for example 50 V.

Instead of using two Zener diodes $Z_1$ and $Z_2$ it is possible to use but one Zener diode, namely $Z_2$ without the Zener diode $Z_1$. Such a circuit, however, would make the decay characteristic non-symmetric and slightly prolong the decay time. However, a circuit with but one Zener diode has the substantial advantage of limiting the loss of the ignition voltage to less than 1 V.

Any leakage currents of the Zener diodes do not have any negative influence on the subsequently performed ion current measurement because in both instances, whether one or two Zener diodes are used, the Zener diode or diodes are connected in series to the secondary windings $S_1 \ldots S_4$ of the ignition transformers $Tr_1 \ldots Tr_4$ and also in series to the ion current measuring resistor $R_1$. Once the ignition current and any remainder energies have been dissipated the reference voltage $U_{ref}$ is applied by the inverting differential amplifier 3 to the secondary windings $S_1$ to $S_4$ where the reference voltage now functions as a measuring voltage $U_{test}$, whereby an ion current is generated at the respective spark plug.

The inverting differential amplifier 3 provides at its output a voltage drop $U_{ion}$ that at this time is proportional to the ion current flowing through the feedback resistor $R_1$. This proportional voltage $U_{ion}$ is supplied to the evaluating circuit 5, the output of which is supplied to the central processing unit 4. The voltage serving as a measuring or testing voltage $U_{test}$ supplied to the secondary windings $S_1 \ldots S_4$ of the ignition transformer $Tr_1 \ldots Tr_4$ is within the range of 5 to 30 V and preferably 20 V as mentioned above. This voltage is constant during the entire ion current measuring phase. Since the ion current is within a $\mu$A range, the differential amplifier 3 is selected to have a low input current. Such differential amplifiers are readily available on the market at reasonable costs. According to the invention the testing voltage $U_{test}$ corresponding to the reference voltage is provided as a low impedance voltage, whereby any recharging of stray capacities is avoided. Such recharging takes place in conventional systems using alternating current loading, for example, when the engine is knocking. Avoiding such recharging is a further advantage of the invention which is particularly noticeable when several ion measuring paths are connected in parallel as shown in FIG. 1 because in such a circuit the effective stray capacities all parallel circuits could be multiplied. The invention prevents any stray capacities from becoming adversely effective.

In order to limit the current flowing into the differential amplifier 3, a resistor may be connected between the common circuit point S and the inverting input (–) of the amplifier 3. This resistor is not shown in the drawings.

Figure 2:
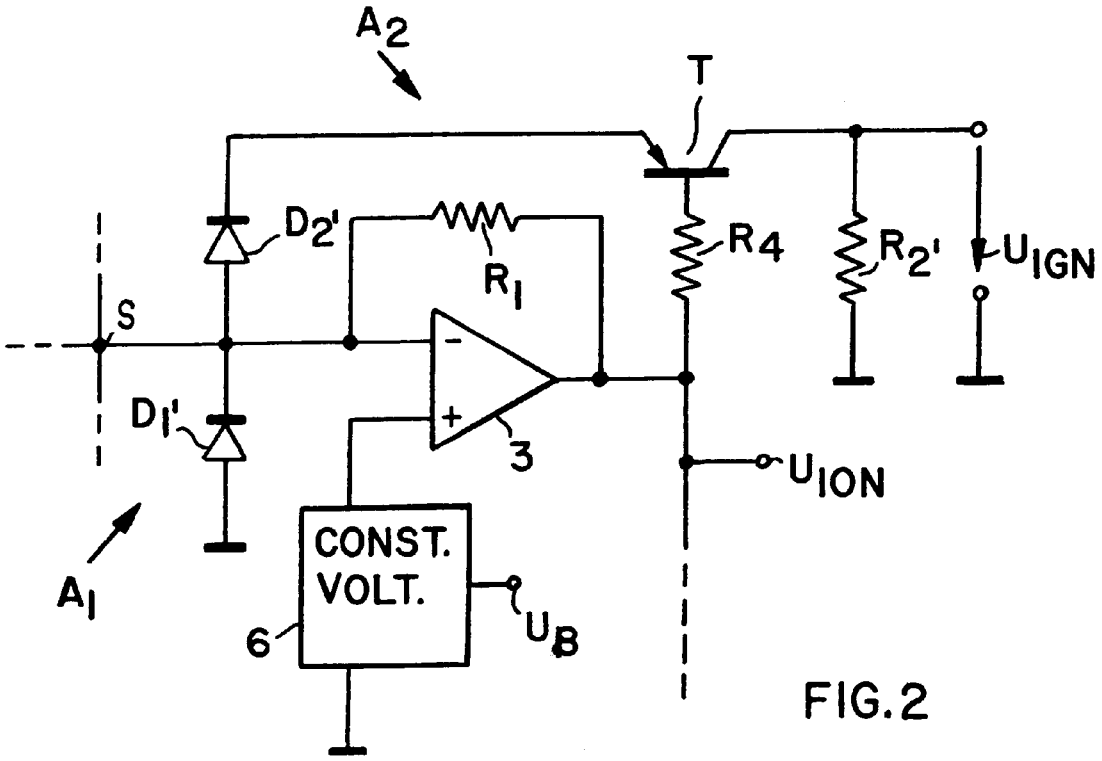
FIG. 2 illustrates a circuit diagram of a diverting circuit according to the invention with a modified second branch of the diverting circuit.

FIG. 2 shows a modification of the diverting circuit branch $A_2$ without showing the remainder of FIG. 1. The first diverting branch is the same as in FIG. 1 with a single diode $D_1$. In FIG. 2 the ignition current measuring resistor $R_2$ is connected between ground and the collector electrode of the transistor T. The measured voltage $U_{ign}$ is now measured as a voltage drop relative to ground potential which is advantageous for the further processing of the voltage $U_{ign}$ that is proportional to the ignition or secondary current $I_{sec}$. The ion current measuring feedback resistor $R_1$ is connected as in FIG. 1.

FIG. 2 shows a further resistor $R_4$ connected between the base of the transistor T and the output of the differential amplifier 3. This resistor $R_4$ limits any measuring error that could be caused by the base current to small negligible values.

As mentioned above, the ion current signal can be used to detect any engine knocking and the respective signal is then processed to provide a control signal of the ignition timing to reduce or eliminate knocking. The signal proportional to the ion current can also be used for detecting ignition failures as well as for detecting the position of the cam shaft relative to the position of the crankshaft.

The circuit arrangement according to the invention is useful for the ion current measurement not only in transistor ignition systems, but also in alternating current ignition systems and in high voltage capacitor ignition systems.

Although the invention has been described with reference to specific example embodiments, it will be appreciated that it is intended to cover all modifications and equivalents within the scope of the appended claims.

What is claimed is:

1. A circuit arrangement for measuring an ion current in a combustion chamber of an internal combustion engine during an ion current flow phase between ignition phases, comprising at least one ignition transformer including a primary winding and a secondary winding, a spark plug connected between a high voltage end of said secondary winding and ground, an inverting amplifier (3) connected with an input to a low voltage end of said secondary winding for producing a constant measuring voltage applied to said secondary winding during at least one of said ion current flow phases for generating an ion current in said combustion chamber, and a first resistor ($R_1$) connected so that said ion current causes a proportional voltage drop across said first resistor ($R_1$) for measuring said ion current, said circuit arrangement further comprising a diverting circuit including a first diverting branch ($A_1$) comprising a first semiconductor diode ($D_1$) connected between ground and said low voltage end of said secondary winding for dissipating negative high voltage peaks, and a second diverting branch ($A_2$) connected in parallel to said inverting amplifier (3), said second diverting branch ($A_2$) comprising a series connection including an ignition current measuring second resistor ($R_2$ or $R_2'$), a second semiconductor diode ($D_2$) and a controllable semiconductor switch (T), said series connection being connected to ground, said semiconductor switch (T) having a control input connected to an output of said inverting amplifier (3) for switching said semiconductor switch (T) to the "ON" state and thereby shunting an ignition current flowing during said ignition phase to ground through said series connection.

2. The circuit arrangement of claim 1, wherein said semiconductor switch (T) is a transistor (T) having a base connected to said output of said inverting amplifier (3), and an emitter and a collector forming an emitter-collector path connected in said series connection.

3. The circuit arrangement of claim 2, wherein said ignition current measuring second resistor ($R_2$) is connected to said emitter of said transistor (T).

4. The circuit arrangement of claim 2, wherein said ignition current measuring second resistor ($R_2'$) is connected to said collector of said transistor (T).

5. The circuit arrangement of claim 4, wherein said ignition current measuring second resistor ($R_2'$) is connected between said collector and ground, and wherein a voltage drop ($U_{ign}$) across said ignition current measuring second resistor ($R_2'$) is representative or proportional to said ignition current.

6. The circuit arrangement of claim 2, further comprising a base current limiting fourth resistor ($R_4$) connected between said base of said transistor (T) and said output of said differential amplifier (3) for minimizing any measuring errors.

7. The circuit arrangement of claim 1, wherein said inverting amplifier is a differential amplifier having a first input (–) and a second input (+).

8. The circuit arrangement of claim 7, wherein said first input (–) of said differential amplifier (3) is connected to said low voltage end (S) of said secondary winding of said at least one ignition transformer (TR), said circuit arrangement further comprising a constant voltage source (6) connected to said second input (+) of said differential amplifier (3) for supplying a constant reference voltage ($U_{ref}$) to said second input, said constant reference voltage ($U_{ref}$) corresponding to a measuring voltage ($U_{test}$), and wherein said first resistor ($R_1$) causing said proportional voltage drop for measuring said ion current is connected to said first input (−) of said differential amplifier (3) and to an output of said differential amplifier, whereby said first resistor ($R_1$) functions as a feedback circuit during said ignition phases and as an ion current measuring resistor during said ion current flow phases.

9. The circuit arrangement of claim 8, further comprising an evaluating circuit (5) connected to an output of said differential amplifier, and a central processing unit (4) connected to an output of said evaluating circuit (5) for processing signals available at said output of said differential amplifier.

10. The circuit arrangement of claim 8, wherein said first input of said differential amplifier is an inverting input, and wherein said second input of said differential amplifier is a non-inverting input.

11. The circuit arrangement of claim 8, wherein said constant voltage source delivers a constant voltage that is within the range of 5 to 30 volts.

12. The circuit arrangement of claim 1, further comprising a parallel circuit including a dissipation third resistor ($R_3$) and at least one Zener diode ($Z_1$), said parallel circuit being connected in series with said secondary winding and said first semiconductor diode ($D_1$).

13. The circuit arrangement of claim 12, comprising two Zener diodes connected in anti-serial fashion with each other and in parallel to said dissipation third resistor ($R_3$).

14. The circuit arrangement of claim 1, wherein said ignition current measuring second resistor ($R_2$) provides a voltage drop that is representative of an ignition current flowing during said ignition phases.

* * * * *